US007031637B2

(12) United States Patent
Fujita

(10) Patent No.: US 7,031,637 B2
(45) Date of Patent: Apr. 18, 2006

(54) IMAGE FORMING APPARATUS HAVING IMAGE FORMING UNITS PERPENDICULAR TO DEVELOPER SUPPLY UNITS

(75) Inventor: Keiko Fujita, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/401,881

(22) Filed: Mar. 31, 2003

(65) Prior Publication Data

US 2003/0185589 A1 Oct. 2, 2003

(30) Foreign Application Priority Data

Apr. 1, 2002 (JP) ..... 2002-098622

(51) Int. Cl.
*G03G 21/06* (2006.01)
*G03G 15/01* (2006.01)

(52) U.S. Cl. ..... 399/111; 399/110; 399/119; 399/223

(58) Field of Classification Search ..... 399/107, 399/110–112, 119, 223–226, 228–332, 254–260, 399/298–300
See application file for complete search history.

(56) References Cited

U.S. PATENT DOCUMENTS 4,878,091 A * 10/1989 Morita et al. ..... 399/224
4,937,625 A * 6/1990 Kato et al. ..... 399/258
5,282,002 A * 1/1994 Jacobs et al. ..... 399/119
5,331,381 A * 7/1994 Ota et al. ..... 399/258
5,379,096 A * 1/1995 Nakakuma et al. ..... 399/226
6,347,199 B1 * 2/2002 Morihara ..... 399/224
6,453,135 B1 9/2002 Sameshima et al. ..... 399/110

FOREIGN PATENT DOCUMENTS

JP 4-107471 4/1992
JP 2000235289 A * 8/2000
JP 2000-258981 9/2000
JP 2001272899 A * 10/2001

* cited by examiner

*Primary Examiner*—Arthur T. Grimley
*Assistant Examiner*—Ryan Gleitz
(74) *Attorney, Agent, or Firm*—Fitzpatrick, Cellar, Harper & Scinto

(57) ABSTRACT

The present invention relates to an image forming apparatus comprising a plurality of image forming units for forming images, the image forming units being detachably arranged in the image forming apparatus, and a plurality of developer supplying units arranged corresponding to each of the image forming units for supplying developing agents to the image forming units, the developer supplying units being detachably attached to the image forming apparatus. The image forming units and the developer supplying units are alternatively so disposed that one end in a longitudinal direction of the respective image forming units intersects with one end in a longitudinal direction of the respective developer supplying units.

4 Claims, 3 Drawing Sheets

(a)

(a)

(b)

IMAGE FORMING APPARATUS HAVING IMAGE FORMING UNITS PERPENDICULAR TO DEVELOPER SUPPLY UNITS

BACKGROUND OF THE INVENTION

1. Field of the Invention

This invention relates to an image forming apparatus using an electrophotographic method and, more particularly, to an image forming apparatus such as a photocopier, printer, and facsimile machine.

2. Description of Related Art

Color image forming apparatuses generally form color images on a recording medium in a sheet shape or the like by transferring, in an overlapping manner, developers in four colors in total of yellow, magenta, cyan, and black.

The color image forming apparatuses are generally categorized into a single drum type having a single photosensitive drum and a multiple drum type (hereinafter referred to as "tandem type") having a plurality of photosensitive drums. The single drum type needs to repeat an image forming process four times for images on one page, but the tandem type can form the four color developers step by step in an overlapping manner, so that the tandem type image forming apparatus is becoming major among the color image forming apparatuses targeting high speed operation.

The conventional tandem type color image forming apparatus, however, raises problems such as a tendency to increase maintenance costs as well as to render the apparatuses larger from the design to arrange the plural photosensitive drums in parallel.

To avoid the above problems, it is important to render optimized the replacement cycle of process cartridges including a photosensitive drum as a consumptive part, and image forming parts (namely, processing means) such as a charger, a developing unit, and a cleaner which are arranged around the photosensitive drum and to render the process cartridge itself compact to reduce the distance between the drums placed adjacently.

As a structure of the process cartridge, there are a so-called united body type cartridge in which developer containers for containing developers are incorporated as a united body, and a so-called supplement type cartridge in which the developer containers are separately formed. The united body type cartridge enjoys improved maintenance workability because all consumptive parts can be replaced at one time per color. The united body type cartridge requires replacing the cartridge according to the remaining amount of the developing agents even where the image forming parts do not yet reach the duration, thereby possibly increasing the maintenance costs, or requires increasing the amounts of the developing agents in matching the duration of the image forming parts, thereby possibly rendering larger the cartridges and the apparatuses.

With the tandem type color image forming apparatuses aiming at reduction of the maintenance costs and the apparatus sizes, it is desirable to use a supplement type cartridge structure which allows proper replacements of the developer containers according to the remaining developing agent amount and of the process cartridge according to the part's duration and in which the developer containers requiring an adequate volume are freely placed at locations apart from the process cartridge.

With the supplement type cartridge, however, supplying routes for developing agents extending from the developer containers to the process cartridge have to be newly arranged, whereas the developer containers are more freely placed so as to reduce the distances between the drums, so that the apparatus may be formed in a larger size with higher costs. Otherwise, where the developer container is placed adjacently to the process cartridge, the developing container and the process cartridge are necessarily detached in different directions to avoid interferences between the developing container and the process cartridge at attaching or detaching times, thereby possibly rendering worse the maintenance manipulation property.

SUMMARY OF THE INVENTION

It is an object of the invention to provide an image forming apparatus with improved usability and that efficiently utilizes the space inside the image forming apparatus.

Other objects of the invention will become apparent upon reading the following detailed description with reference to the attached drawings.

A representative structure of an image forming apparatus according to the invention includes a plurality of image forming units for forming images, the image forming units being detachably arranged to the image forming apparatus, and a plurality of developer supplying units arranged corresponding to each of the image forming units for supplying developing agents to the image forming units, the developer supplying units being detachably attached to the image forming apparatus, wherein the image forming units and the developer supplying units are alternatively so disposed that one end in a longitudinal direction of the respective image forming units intersects with one end in a longitudinal direction of the respective developer supplying units.

With the above structure, the image forming apparatus can utilize efficiently a space surrounded by the image forming units and the developer supplying units. For example, the image forming apparatus can optimize the whole structure by arranging the optical system in the space.

DETAILED DESCRIPTION OF THE PREFERRED EMBODIMENTS

Figure 1:
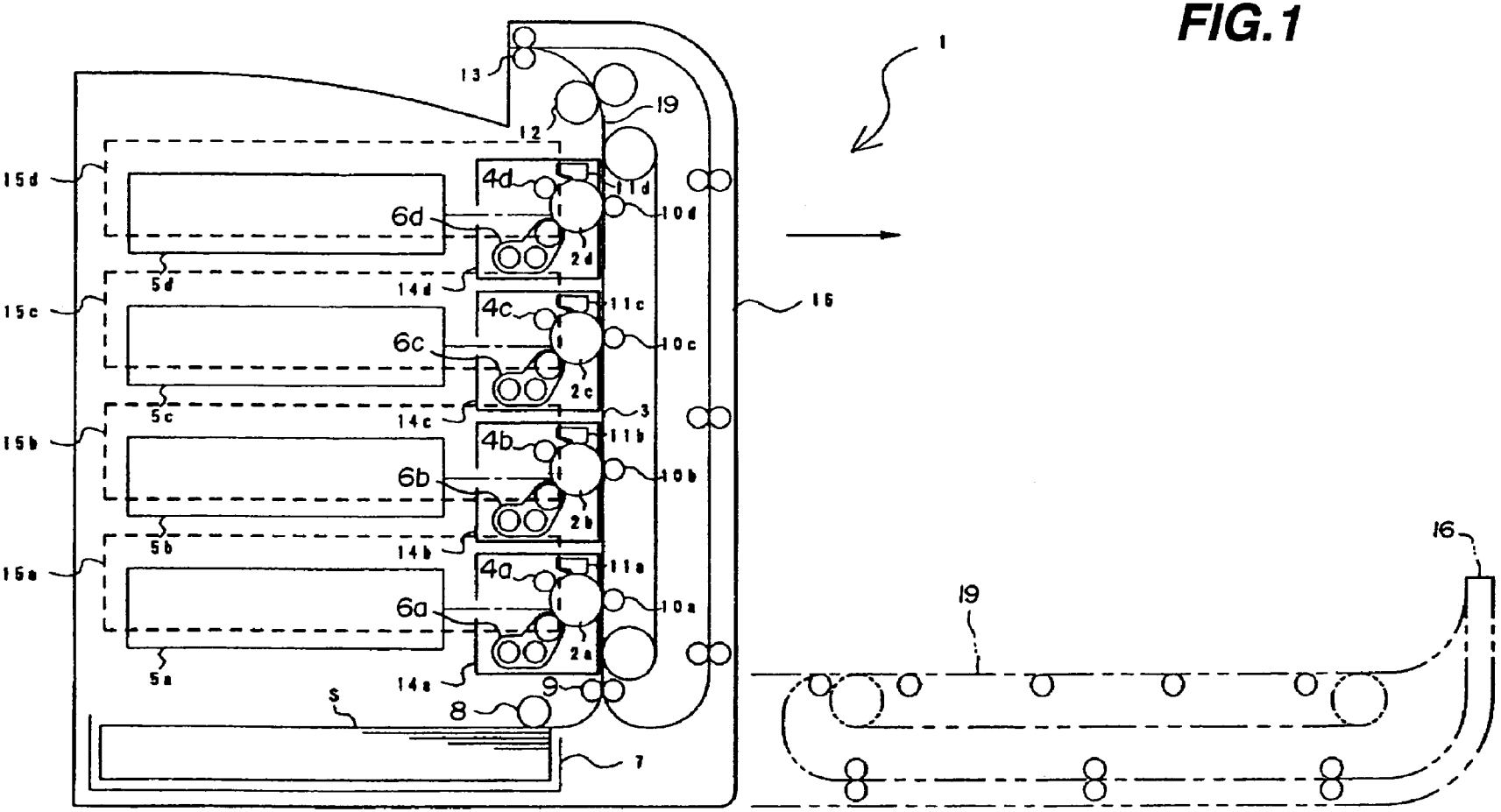
FIG. 1 is a cross section showing an image forming apparatus according to the first embodiment.

Hereinafter, referring to the drawings, the preferred embodiments according to the invention are described in detail in an exemplifying manner. Sizes, materials, shapes, and correlative positions of the structural parts as set forth in the following embodiments can be properly modified according to the structure of an apparatus to which this invention applies or various conditions, and as far as no restrictive description is set forth, it is intended that the scope of the invention is not limited to those.

First Embodiment

Figure 2:
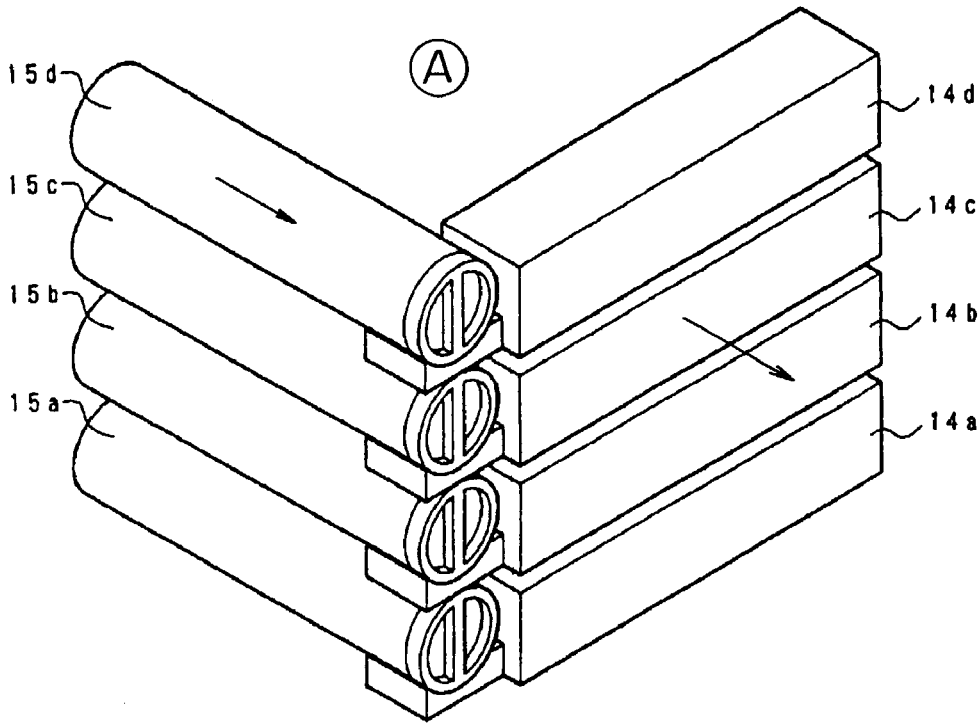
FIG. 2 is a perspective view showing photosensitive drums and developing containers according to the first embodiment.
Figure 2:
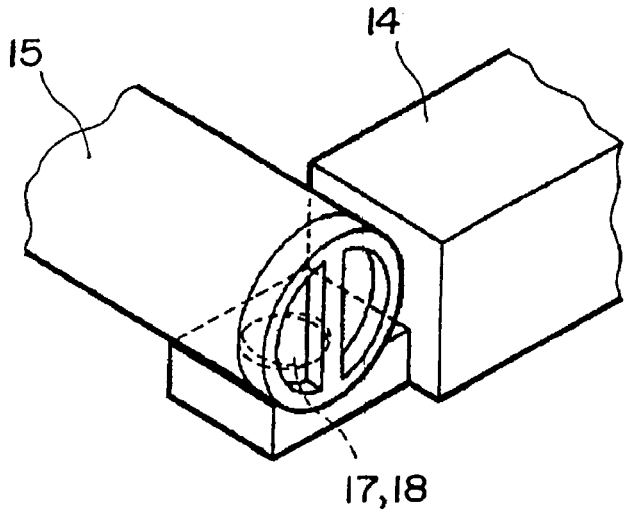

Referring to FIG. 1 and FIG. 2, an image forming apparatus according to the first embodiment is described. It is to be noted that in this embodiment a color printer is exemplified as an image forming apparatus. FIG. 1 is a cross section showing a color printer serving as an image forming apparatus. An image forming process in the printer shown in FIG. 1 is described below.

A printer body 1 includes four photosensitive drums (yellow 2*a*, magenta 2*b*, cyan 2*c*, black 2*d*) serving as image carriers disposed in parallel in an up and down direction, image forming means placed around the photosensitive drum, and a transfer conveyance belt (recording medium carrier) 3 serving as a belt body disposed in a vertically arranged manner at the sides of the photosensitive drums 2*a* to 2*d*.

Formed on the photosensitive drums 2*a* to 2*d* driven by a motor, not shown, are latent images by radiation of prescribed laser beam based on image data divided for each color component from exposing devices 5*a* to 5*d* after the drums 2*a* to 2*d* are charged uniformly by chargers 4*a* to 4*d* serving as charging means. The respective latent images are developed by developing units 6*a* to 6*d* serving as developing means to form developed images in yellow, magenta, cyan, and black on the respective photosensitive drums 2*a* to 2*d* step by step.

A sheet S as a recording medium is contained in a cassette 7 inside the printer 1. The sheet is fed sheet by sheet according to selective rotational drive of a feeding roller 8, and after timing is matched at a registration roller 9, the sheet is conveyed upon being put on the transfer conveyance belt 3.

The developing images in the respective colors on the photosensitive drums 2*a* to 2*d* are transferred onto the sheet S step by step in an overlapping manner by operation of transfer rollers 10*a* to 10*d* disposed at respective transfer portions serving as transferring means to which a voltage of a polarity reverse to the developing agent is applied. With the photosensitive drums 2*a* to 2*d* after the end of transferring operation, the remaining developing agents are removed by cleaners 11*a* to 11*d* serving as cleaning means, and the developing agents collected by the cleaners 11*a* to 11*d* are conveyed to a waste developing bottle not shown.

The sheet S on which the four color developed images are transferred in the overlapping manner is separated from a front end in the conveyance direction at a curving portion on a downstream side in the sheet conveyance direction of the transfer conveyance belt 3 and is conveyed to a fixing unit 12 serving as a fixing means.

The developing agents of the respective colors receiving heat and pressure at the fixing unit 12 are secured by melting and mixing on the sheet S, so that printed images of the full color are fixed as permanent images.

The sheet S to which the developing agent images are fixed is delivered to the exterior of the printer 1 through a delivery roller 13.

Meanwhile, the printer 1 according to the embodiment includes image forming units (hereinafter referred to as "process cartridges") 14*a* to 14*d* in which image forming parts 14*a* to 14*d* (namely, processing means) are made unitedly of, for example, photosensitive drums 2*a* to 2*d* as consumptive parts, chargers 4*a* to 4*d*, developing units 6*a* to 6*d*, and cleaners 11*a* to 11*d*, and the process cartridges 14*a* to 14*d* are detachably attached to the printer body 1. Those process cartridges 14*a* to 14*d* are made compact so as to have the photosensitive drums 2*a* to 2*d* with a diameter of 20 to 30 mm and a distance between the adjacent drums of 50 to 75 mm. As shown in FIG. 1, even where the photosensitive drums 2*a* to 2*d* are arranged in a vertical direction, the height of the apparatus is set to about 250 to 400 mm, so that the apparatus is never made large in comparison with conventional printers forming color images using a single photosensitive drum.

As shown with a broken line in FIG. 1 and as shown in a perspective view of FIG. 2, developer supplying units 15*a* to 15*d* (hereinafter referred to as "developer container or containers") containing the developing agents to be supplied to the respective cartridges are structured as separate body from the process cartridges 14*a* to 14*d*, and those can be replaced independently to each other with a proper replacement cycle. Therefore, the running costs will not be increased.

The developer containers 15*a* to 15*d* as the developer supplying units according to the embodiment are arranged alternatively in a vertical direction as a direction perpendicular to the longitudinal direction of the developer containers 15*a* to 15*d* with respect to the longitudinal direction of the process cartridges 14*a* to 14*d* as image forming units as shown in the broken line in FIG. 1 and as shown in the perspective view of FIG. 2.

The cartridges 14*a* to 14*d* and the developer containers 15*a* to 15*d* are arranged alternatively so that one end in the longitudinal direction of the respective developer containers 15*a* to 15*d* is located above one end in the longitudinal direction of the respective cartridges 14*a* to 14*d*.

With this structure, even where the process cartridges 14*a* to 14*d* are structured to have a narrow interval between the photosensitive drums adjacent to each other, a developing agent outlet 17 of the developer containers 15*a* to 15*d* and a developing agent inlet 18 of the process cartridges 14*a* to 14*d* can be placed in an adjacent manner in the up and down direction as shown in FIG. 2(*b*), so that no developing agent supplying route is necessarily formed between the developer containers 15*a* to 15*d* and the process cartridges 14*a* to 14*d*, so that the apparatus can be formed with a compact structure and lower costs.

With the printer body 1 according to the embodiment, paper jamming clearance can be done easily at all the conveyance routes through a space formed thereat by opening one door 16 formed in an openable manner at a front side of the apparatus as shown in FIG. 1, because the conveyance route 19 of the sheet S is disposed only at one side (front side) of the printer 1 by arranging the process cartridges 14*a* to 14*d* in the up and down direction (vertical direction). It is to be noted that in this embodiment, the belt 19 has a structure to escape together with the door 16 as shown with a broken line in FIG. 1, and can improve the usability from viewpoints to the jamming treatment and the easiness of replacement of the cartridges.

Because the apparatus has a structure that the process cartridges 14*a* to 14*d* and the developer containers 15*a* to 15*d* come to be exposed when the jamming treatment door 16 is opened, both of jamming treatments and the replacements of the maintenance parts can be done commonly from a front side of the apparatus by merely opening and closing the sole door 16 by rendering the attaching and detaching direction of the process cartridges 14*a* to 14*d* and the developer containers 15*a* to 15*d* the same direction (arrow directions in FIG. 1 to FIG. 3), so that in addition to the above advantages the apparatus can improve the workability without making the apparatus larger, and so that the apparatus structure can be simplified and made less expensively because no more than the sole opening door is needed as a necessary opening and closing means.

Second Embodiment

Figure 3:
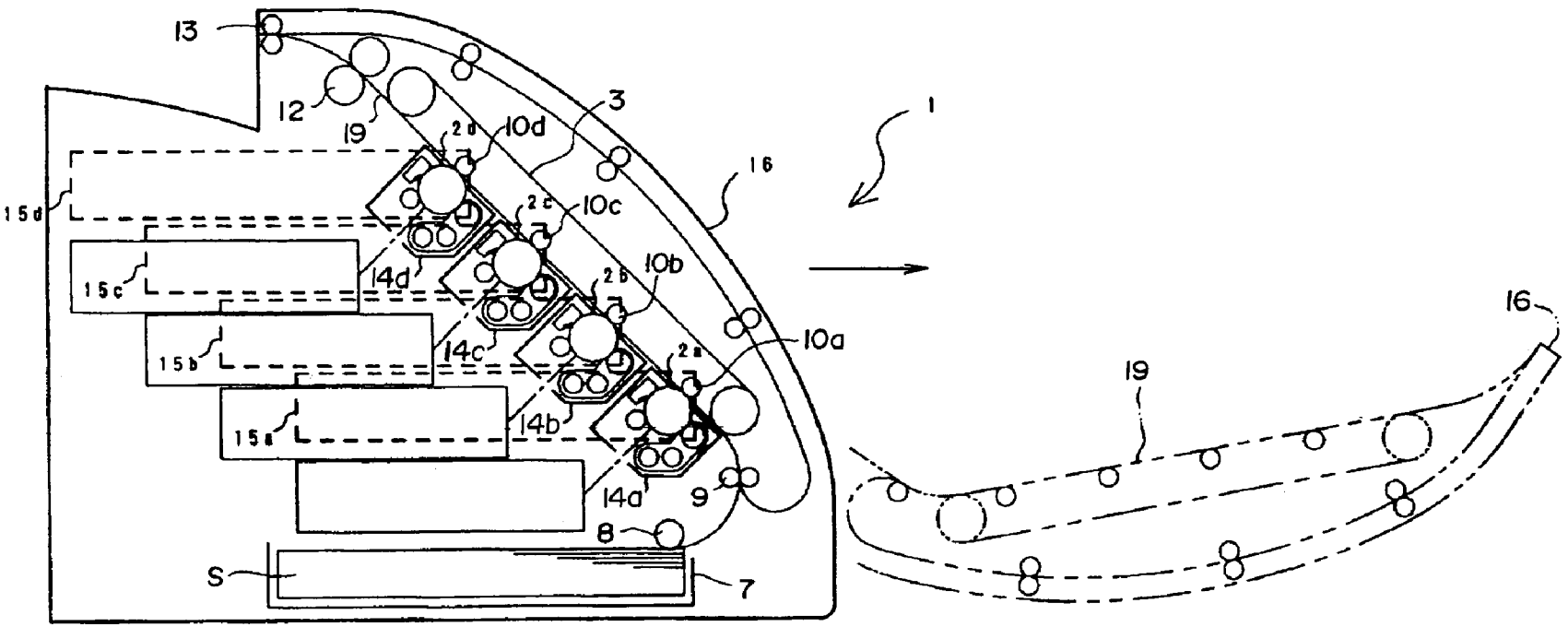
FIG. 3 is a cross section showing an image forming apparatus according to the second embodiment.

In the first embodiment as described above, the structure in which the process cartridges 14*a* to 14*d* are disposed in parallel in the vertical direction has been given as an example, but this invention is not limited to this structure. For example, as shown in FIG. 3, it can be an image forming apparatus having a structure in which process cartridges 14*a* to 14*d* are disposed in a slant manner in parallel.

With this structure, no change is made to the process cartridges 14*a* to 14*d* disposed in parallel as different from each other in the position in the up and down direction. The longitudinal direction of the respective developer containers 15*a* to 15*d* is located in a direction substantially perpendicular to the longitudinal direction of the respective cartridges 14*a* to 14*d*, and the developing agent outlet formed at one end in the longitudinal direction of the developer containers 15*a* to 15*d* and a developing agent inlet 18 formed at one end of the longitudinal direction of the process cartridges 14*a* to 14*d* can be placed in an adjacent manner in the up and down direction. Therefore, a space (A in FIG. 2) surrounded by the developer containers 15*a* to 15*d* and the process cartridges 14*a* to 14*d* can be formed effectively, and in this embodiment, exposing units 5*a* to 5*d* can be placed thereat. Accordingly, this apparatus allows various members to be placed properly in utilizing the space efficiently inside the image forming apparatus, thereby improving the balance of the entire image forming apparatus.

No new developing agent supplying route or conveyance members are required between the developer containers 15*a* to 15*d* and the process cartridges 14*a* to 14*d*, so that the apparatus can be made compact with less costs. This structure can reduce the size in height of the image forming apparatus much more than the structure shown in the first embodiment.

With this apparatus, both of jamming treatments and the replacements of the maintenance parts can be done commonly from a front side of the apparatus in the same manner as the first embodiment, thereby improving the workability and rendering the apparatus structure simpler with less costs.

Other Embodiments

In the embodiments as described above, the apparatus in which the plural image forming units are disposed in parallel at different positions in the up and down (e.g., vertical) direction has been given as an example, but this invention is not limited to this structure, and substantially the same advantages can be obtained by application of the invention to the apparatus even where the plural image forming units are disposed in parallel in a horizontal direction (lateral direction).

With the above embodiment, an image forming apparatus in which an image forming unit (cartridge) made unitedly of the image carrier (photosensitive drum), developing means as image forming means for forming images on the carrier (means relating to the image formation), cleaning means, and charging means are detachably attached is described as an example, but this invention is not limited to this structure. For example, this invention is operative even where the image forming means solely is detachably attached to the image forming apparatus.

As an image forming unit (cartridge) detachably attached to the image forming apparatus body, e.g., a cartridge having at least image forming means may be used notwithstanding of a process cartridge having, in a united body, such as the image carrier, developing means as image forming means for forming images on the carrier (means relating to the image formation), cleaning means, and charging means.

As an image forming means, a cartridge may be used having any one of the charging means and the cleaning means.

Although in the above embodiments the printers are exemplified as the image forming apparatus, this invention is not limited to this, and this invention can be an image forming apparatus such as a photocopier, a facsimile machine, or the like, and can be an image forming apparatus in which developing agent images on an intermediate transfer body are transferred onto a recording medium at one time after the developing agent images in the respective colors are transferred step by step in an overlapping manner from the image carrier (photosensitive body) described above to the intermediate transfer body. Substantially the same advantages can be obtained in application of this invention to such an image forming apparatus.

Although in the above embodiments the developer supplying units are exemplified as disposed so that the longitudinal direction of the developer supplying units is disposed substantially perpendicularly to the longitudinal direction of the image forming units, this invention is not limited to this. The developer supplying units can have substantially the same advantages by application of this invention as far as having a structure that the longitudinal direction of the developer supplying units intersects with the longitudinal direction of the image forming units. It is to be noted that because the volume inside the image forming apparatus can be used advantageously where the developer supplying units and the image forming units are disposed in a manner perpendicularly to each other (or namely, a space not used when the units are attached or detached can be reduced effectively), such a structure is desirable.

As described above, according to the invention, an image forming apparatus can be provided without forming any new developing agent supplying route and rendering worse the workability and with lower maintenance costs, a compact apparatus body, and an excellency in jamming treatments and maintenance workability.

According to the above structure, the units of the two different types can be detachably attached in substantially the same direction without making the apparatus larger where the attaching and detaching direction of the units of the two different types is set to substantially the same direction.

What is claimed is:

1. An image forming apparatus comprising:

a plurality of image forming units, each having an image carrier and a developing device for developing latent images on the image carrier, the image forming units capable of being detachably attached in a predetermined direction to the image forming apparatus; and a plurality of developer supplying units arranged corresponding to each of the image forming units for supplying developer to the image forming units, the developer supplying units capable of being detachably attached in the predetermined direction to the image forming apparatus, wherein the image forming units and the developer supplying units are alternately so disposed that one end in a longitudinal direction of the respective image forming units intersects with one end in a longitudinal direction of the respective developer supplying units, and the image forming units and the developer supplying units are so disposed that the longitudinal direction of the respective developer supplying units is substantially perpendicular to the longitudinal direction of the respective image forming units, the developer is supplied at portions where the respective developer supplying units and the respective image forming units intersect, and the respective developer supplying units and the respective image forming units are respectively disposed so as not to overlap in movement paths related to attaching or detaching operations and each of said developer supplying units and image forming units is independently detachably attached.

2. The image forming apparatus according to claim 1, further comprising an inlet for receiving developer arranged at the one end in the longitudinal direction of the respective image forming units, and an outlet for discharging the developer arranged at the one end in the longitudinal direction of the respective developer supplying units, wherein the image forming units and the developer supplying units are so disposed that the respective outlets are placed above the corresponding inlets.

3. The image forming apparatus according to claim 1, further comprising an opening means so provided as to be open and closed at the image forming apparatus, and wherein the respective image forming units and the respective developer supplying units are detachably attached through an opening opened by the opening means.

4. The image forming apparatus according to claim 1, wherein the respective image forming units are so disposed as to be different from each other in a position in an up and down direction, and wherein the respective developer supplying units are so disposed as to be different from each other in a position in the up and down direction.

* * * * *

UNITED STATES PATENT AND TRADEMARK OFFICE

CERTIFICATE OF CORRECTION

PATENT NO. : 7,031,637 B2
APPLICATION NO. : 10/401881
DATED : April 18, 2006
INVENTOR(S) : Fujita It is certified that error appears in the above-identified patent and that said Letters Patent is hereby corrected as shown below:

ON THE TITLE PAGE
At Item (56), Foreign Patent Documents, "2000235289" should read --2000-235289-- and "2001272899" should read --2001-272899--.

COLUMN 2
Line 29, "alternatively" should read --alternately--.

COLUMN 4
Line 24, "alternatively" should read --alternately--.
Line 49, "escape" should read --open--.
Line 50, "from" should read --as regards--.
Line 51, "viewpoints to" should read --the viewpoint of--.

Signed and Sealed this

Thirteenth Day of May, 2008

JON W. DUDAS
*Director of the United States Patent and Trademark Office*